US007909571B2

(12) United States Patent
Wu et al.

(10) Patent No.: US 7,909,571 B2
(45) Date of Patent: Mar. 22, 2011

(54) CENTRIFUGAL FAN AND FRAME THEREOF

(75) Inventors: Chun-Nan Wu, Taoyuan Hsien (TW); Kuo-Tung Hsu, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 581 days.

(21) Appl. No.: 11/227,114

(22) Filed: Sep. 16, 2005

(65) Prior Publication Data

US 2006/0275115 A1 Dec. 7, 2006

(30) Foreign Application Priority Data

Jun. 2, 2005 (TW) ..... 94118152 A

(51) Int. Cl.
*F04D 29/40* (2006.01)

(52) U.S. Cl. ..... 415/206; 415/212.1

(58) Field of Classification Search ..... 415/214.1, 415/231.1, 212.1, 203, 204, 206, 121.1
See application file for complete search history.

(56) References Cited

U.S. PATENT DOCUMENTS

| | | | | |
|---|---|---|---|---|
| 1,215,282 | A * | 2/1917 | Kieser et al. | 415/204 |
| 3,019,963 | A | 2/1962 | Eck | |
| 4,599,042 | A * | 7/1986 | Colliver | 415/204 |
| 4,867,640 | A | 9/1989 | Penlesky et al. | |
| 5,063,832 | A | 11/1991 | Mirumachi et al. | |
| 5,586,861 | A | 12/1996 | Berger | |
| 5,911,751 | A | 6/1999 | Kim | |
| 5,991,751 | A | 11/1999 | Rivette et al. | |
| 6,549,406 | B1 | 4/2003 | Olesiewicz et al. | |
| 6,585,485 | B2 * | 7/2003 | Lee et al. | 415/203 |
| 6,688,379 | B2 * | 2/2004 | Huang et al. | 165/121 |
| 6,725,906 | B2 * | 4/2004 | Lin et al. | 361/695 |
| 6,830,429 | B2 * | 12/2004 | Hirata | 415/206 |
| 2005/0207886 | A1 * | 9/2005 | Chen et al. | 415/206 |
| 2005/0265832 | A1 * | 12/2005 | Horng et al. | 415/206 |
| 2006/0146494 | A1 * | 7/2006 | Chiu et al. | 361/694 |

FOREIGN PATENT DOCUMENTS

| | | | |
|---|---|---|---|
| DE | 2705977 | A1 | 8/1977 |
| FR | 2193182 | | 2/1974 |
| JP | 2000-127740 | A | 5/2000 |
| JP | 2001-182691 | A | 7/2001 |
| WO | WO-01/10537 | A1 | 2/2001 |

* cited by examiner

*Primary Examiner* — Edward Look
*Assistant Examiner* — Dwayne J White
(74) *Attorney, Agent, or Firm* — Birch, Stewart, Kolasch & Birch, LLP

(57) ABSTRACT

A frame for a centrifugal fan. The frame includes an air inlet and an air outlet. A first barricade is formed on one side of the air inlet and extends outwardly, preventing impurities from entering the air inlet. A second barricade is formed on part of the periphery of the air outlet and extends outwardly and axially, contacting a guide plate of a system and reducing reflow of air.

14 Claims, 10 Drawing Sheets

CENTRIFUGAL FAN AND FRAME THEREOF

BACKGROUND

The invention relates to a frame for a centrifugal fan, and in particular to a frame for a centrifugal fan preventing impurities from entering the interior thereof and reducing reflow of air in a system.

Referring to FIG. 1, a conventional centrifugal fan comprises a frame 10, a motor (not shown), and an impeller 30. The frame 10 comprises an air inlet 11 and an air outlet (not shown). The motor is disposed in the frame 10, for activating the impeller 30 which comprises a hub 31, a base plate 32, and a plurality of blades 33 formed on the base plate 32. Air enters the centrifugal fan via the air inlet 11 and flows with the rotation of the impeller 30 and exits from the air outlet.

Referring to FIG. 2A and FIG. 2B, the conventional centrifugal fan is applied in a system 40 in which electronic members (not shown) are disposed. An air inlet 41 is formed on one side of a housing of the system 40. As shown in FIG. 2B, heat in the system 40 is dissipated by the centrifugal fan. Outside air enters the centrifugal fan via the air inlet 41 of the system 40. Air output from the air outlet of the centrifugal fan is forwarded to the interior of the system 40. The aforementioned operation of heat dissipation, however, has a drawback. An airflow output from the air outlet of the centrifugal fan causes reflow of air, reducing heat dissipation from the system 40.

To reduce the reflow of air, another system, as shown in FIG. 3, comprises a guide plate 42 disposed in a housing of the system and tightly abutting the centrifugal fan to reduce the reflow of air.

Specifically, as shown in FIG. 3, the guide plate 42 abuts the centrifugal fan by a surface thereof contacting a turning corner on an outer frame of the centrifugal fan. Accordingly, the guide plate 42 contacts the centrifugal fan merely in a linear manner. Thus, reflow of air is also easily generated when linear contact between the guide plate 42 and the centrifugal fan is incomplete.

Moreover, as the air inlet 41 of the system 40 is connected to the exterior thereof, impurities, such as dust and water drops, may enter the system 40 via the air inlet 41. The impurities may also enter the centrifugal fan, causing damage thereto.

Hence, there is a need for a frame of a centrifugal fan to reduce reflow of air in a system and enhance heat dissipation thereof. In addition, external impurities can be reduced in the centrifugal fan such that damage thereto is prevented.

SUMMARY

Accordingly, an embodiment of the invention provides a frame for a centrifugal fan. The frame comprises an air inlet and an air outlet. A first barricade is formed on one side of the air inlet and extends outward, preventing impurities from entering the air inlet.

Another embodiment of the invention provides a frame for a centrifugal fan. The frame comprises an air inlet and an air outlet. A second barricade is formed on part of the periphery of the air outlet and extends outward. The second barricade tightly abuts a system for preventing reflow of air, enhancing heat dissipation, and increasing rigidity of the frame.

Yet another embodiment of the invention provides a centrifugal fan comprising a frame, an impeller, and a motor. The frame comprises an air inlet and an air outlet. A barricade is formed on one side of the air inlet and extends outward, preventing impurities from entering the air inlet. The impeller is disposed in the frame. The motor is disposed in the frame for activating the impeller.

DESCRIPTION OF THE DRAWINGS

The invention can be more fully understood by reading the subsequent detailed description and examples with references made to the accompanying drawings, wherein.

DETAILED DESCRIPTION

Figure 1:
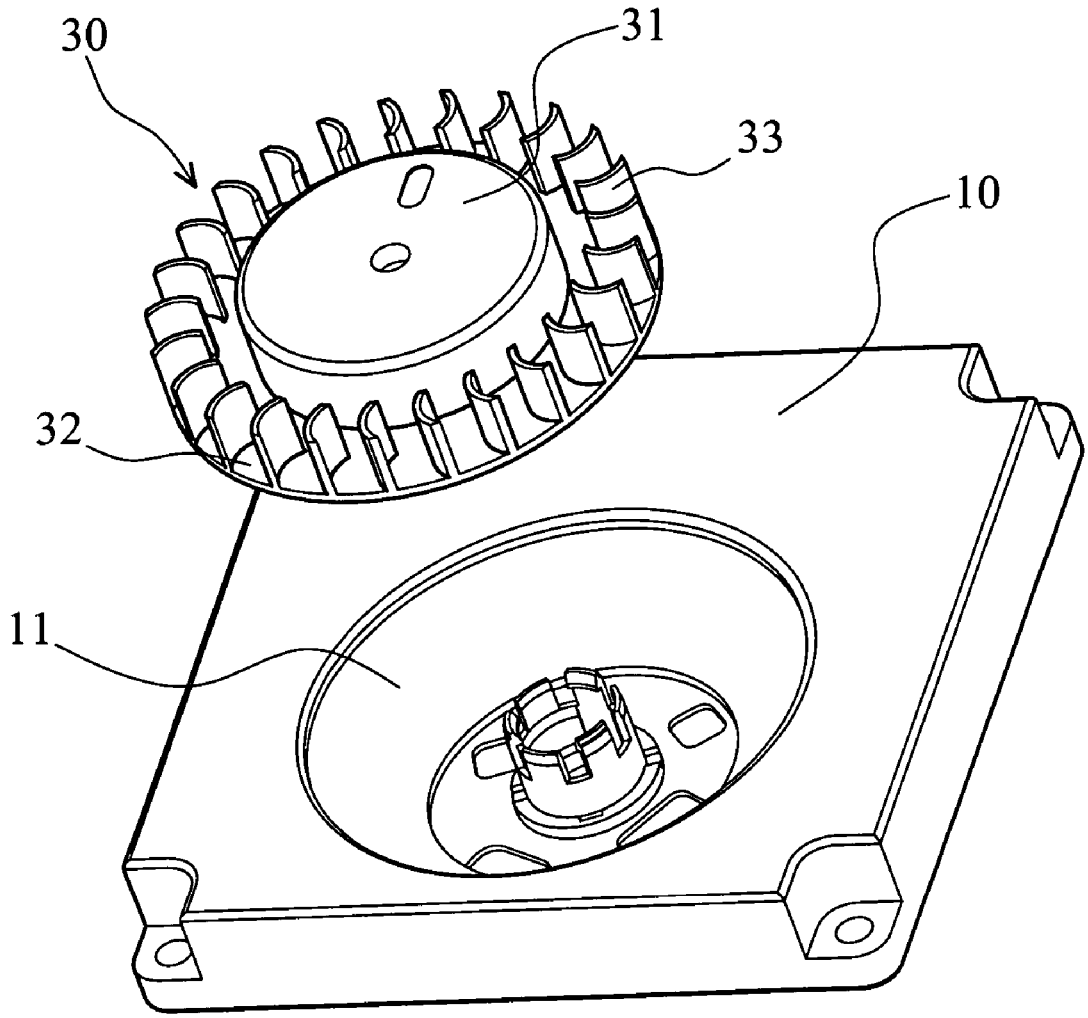
FIG. 1 ( RELATED ART )
FIG. 1 is an exploded perspective view of a conventional centrifugal fan.
Figure 2A:
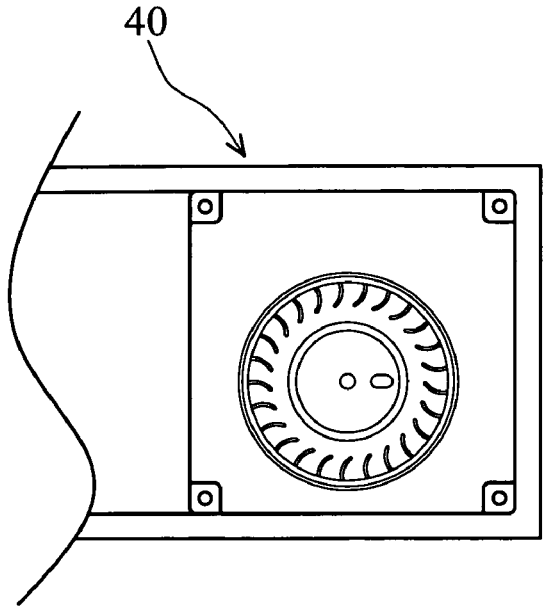
FIG. 2A ( RELATED ART )
FIG. 2A is a schematic top view of a conventional centrifugal fan applied in a system.
Figure 2B:
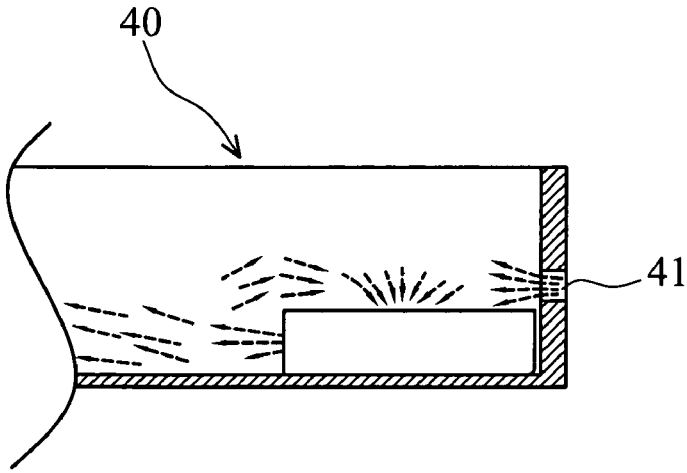
FIG. 2B ( RELATED ART )
FIG. 2B is a schematic side view of a conventional centrifugal fan applied in a system.
Figure 3:
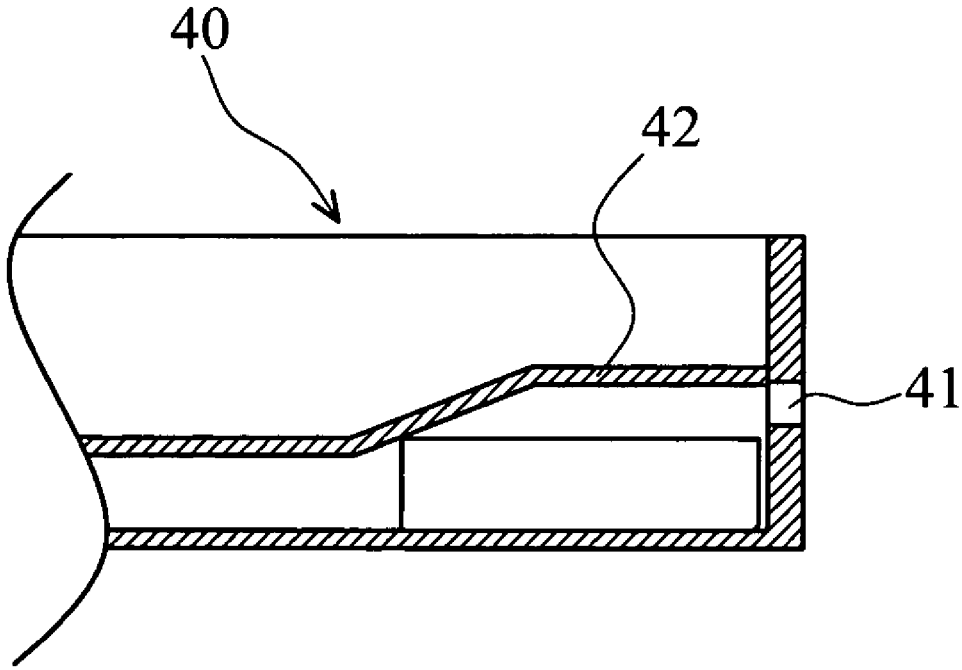
FIG. 3 ( RELATED ART )
FIG. 3 is a schematic side view of a conventional centrifugal fan applied in another system.
Figure 4A:
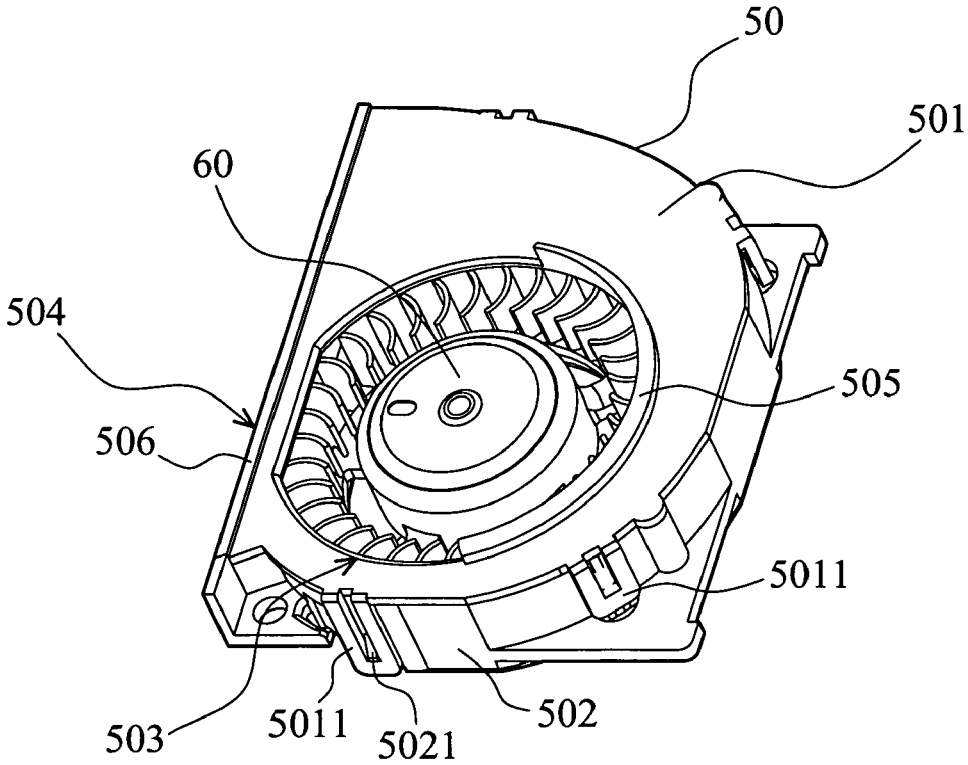
FIG. 4A is a schematic perspective view of the centrifugal fan of an embodiment of the invention.
Figure 4B:
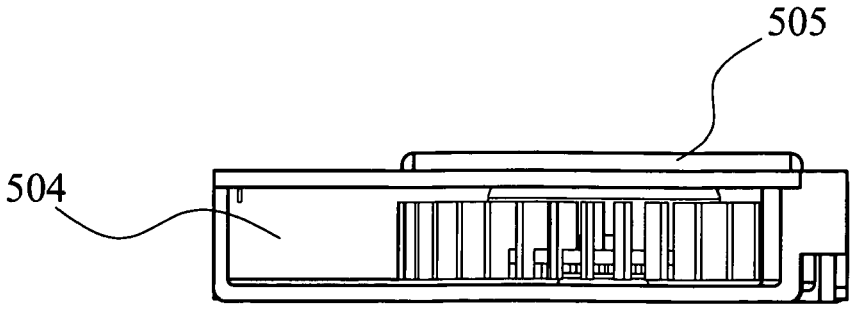
FIG. 4B is a schematic side view of FIG. 4A.
Figure 5:
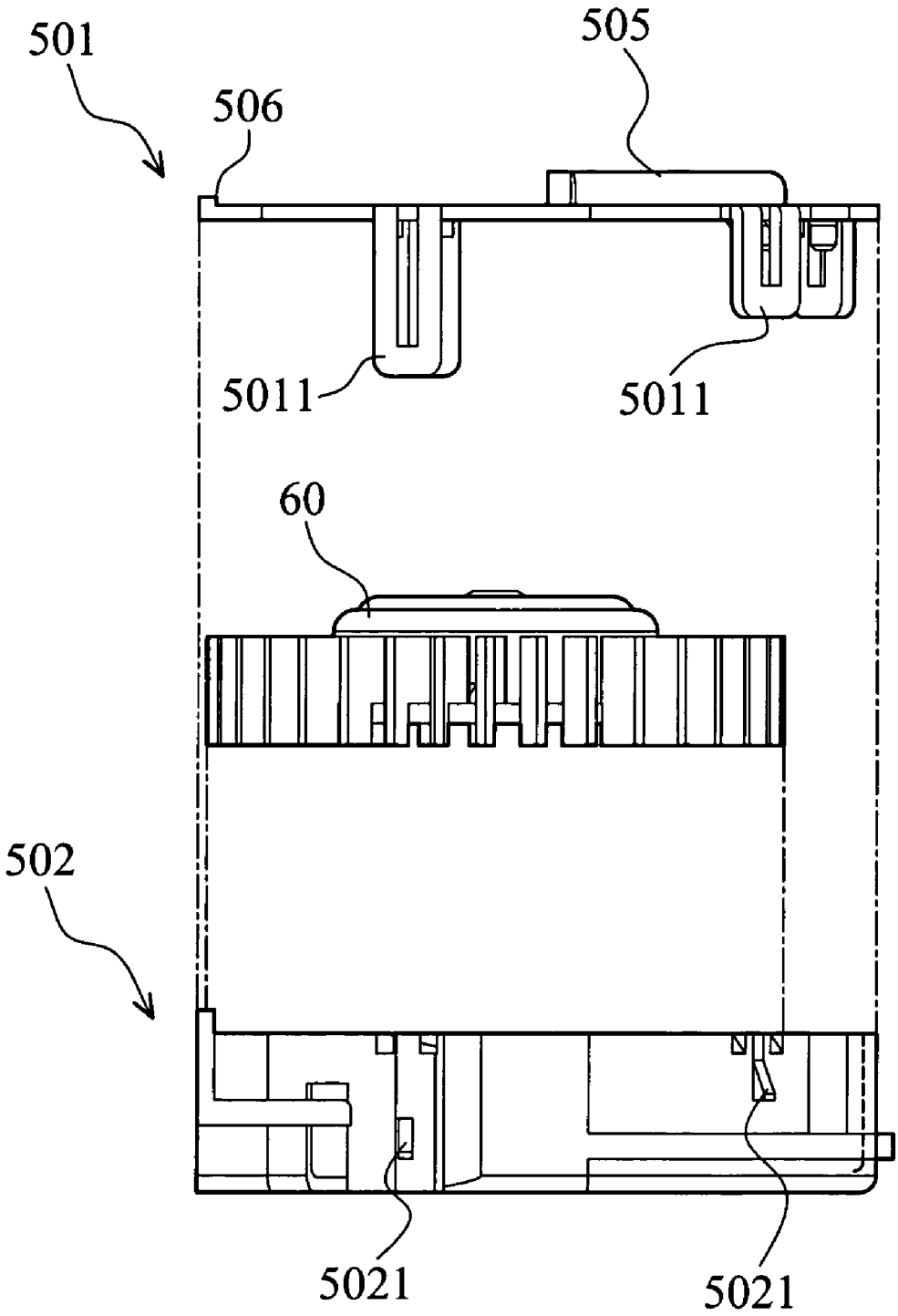
FIG. 5 is an exploded side view of FIG. 4A.

Referring to FIGS. 4A, 4B, and 5, the centrifugal fan comprises a hollow frame 50, an impeller 60, and a motor (not shown) for activating the impeller 60. The motor and impeller 60 are disposed in the frame 50.

The frame 50 comprises a top cover 501 and a bottom cover 502. The frame 50 further comprises an axial air inlet 503 and a sideward air outlet 504. Specifically, the air inlet 503 penetrates the top cover 501 and is formed along an axial direction thereof. The air outlet 504 is formed between a periphery of the top cover 501 and a corresponding periphery of the bottom cover 502. The top cover 501 comprises a plurality of U-shaped retaining rings (first engaging portions) 5011 downwardly formed on the periphery thereof. The bottom cover 502 comprises a plurality of protrusions (second engaging portions) 5021 formed on the sidewall thereof. The U-shaped retaining rings 5011 respectively engage the protrusions 5021 to form the frame 50. In this embodiment, the profile of the frame 50 is substantially D-shaped. Namely, the air outlet 504 outwardly expands from interior of the frame 50 and with respect to an opposite end thereof. The profile of the frame 50 is designed according to the flow of air therein, normalizing the speed and amount of airflow output from the air outlet 504. Thus, heat generated by a heat source with a large area can be dissipated, and space required by the frame 50 can be reduced.

Moreover, a first barricade 505 is axially and upwardly formed on part of the periphery of the air inlet 503 of the top cover 501. The height, curved length, and forming position of the first barricade 505 can be designed as required. Specifically, the first barricade 505 may not be formed on the periphery of the air inlet 503, the curvature thereof may not be the same as that of the periphery of the air inlet 503, and the barricade 505 may not be vertically and upwardly formed. Namely, the first barricade 505 may be separated from the air inlet 503 by a distance, the curvature thereof may be greater or less than that of the periphery of the air inlet 503, and the barricade 505 may be upwardly formed with any sloped angle.

Moreover, a second barricade 506 is formed on part of the periphery of the air outlet 504 and extends outwardly and axially. The height of the second barricade 506 can be designed as required. To reduce space occupied by the frame 50, the air inlet 503 and air outlet 504 can be close to each other. As a portion of the top cover 501 between the air inlet 503 and the air outlet 504 is weak, the second barricade 506 can enhance rigidity thereof. Specifically, part of the periphery of the air inlet 503 near one side of the air outlet 504 is straight and covers part of blades of the impeller 60. Reflow of air can thus be reduced.

Figure 6A:
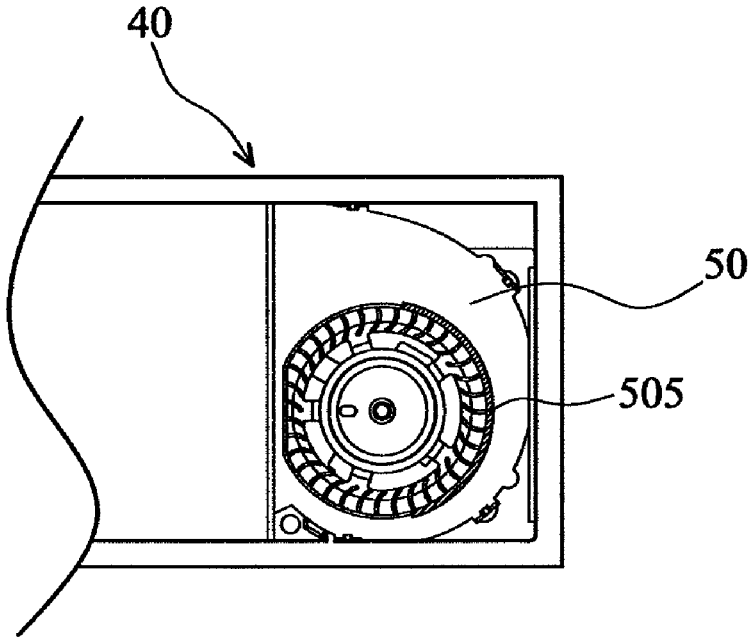
FIG. 6A is a schematic top view of a centrifugal fan of an embodiment of the invention applied in a system.
Figure 6B:
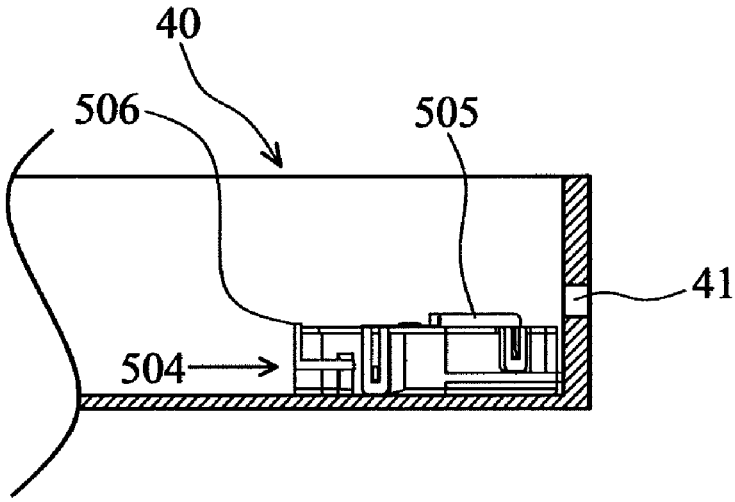
FIG. 6B is a schematic side view of a centrifugal fan of an embodiment of the invention applied in a system.
Figure 6C:
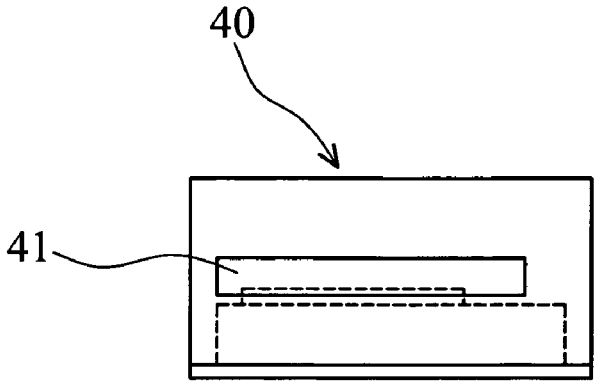
FIG. 6C is a schematic front view of a centrifugal fan of an embodiment of the invention applied in a system.
Figure 7A:
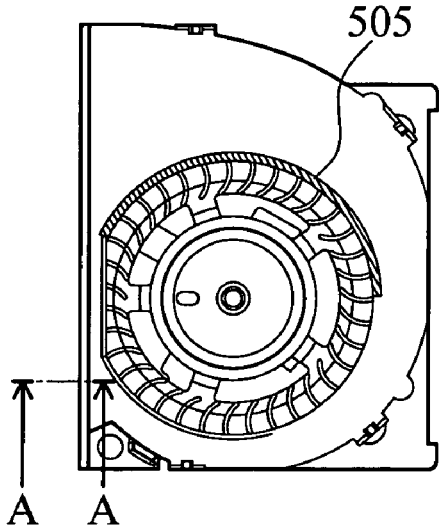
FIG. 7A is a schematic top view of a first barricade of a centrifugal fan of an embodiment of the invention.
Figure 7B:
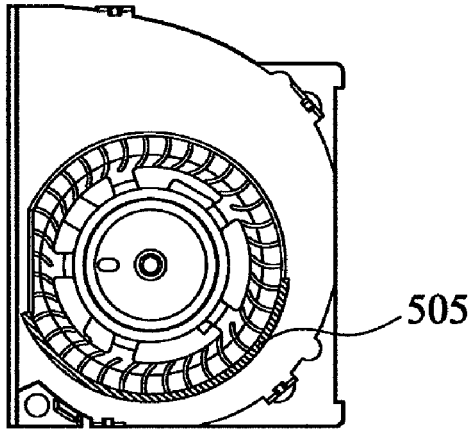
FIG. 7B is another schematic top view of a first barricade of a centrifugal fan of an embodiment of the invention.

Referring to FIGS. 6A, 6B, and 6C, the centrifugal fan can be applied in a system 40 with a housing. Electronic members (not shown) and the centrifugal fan are disposed in the housing. An air inlet 41 is formed on one side of the housing. Heat in the system 40 is dissipated by operation of the centrifugal fan. Specifically, air enters the centrifugal fan via the air inlet 41 of the system 40 and is forwarded to the interior of the system 40 via the air outlet 504 of the centrifugal fan. When the centrifugal fan is disposed in the system 40, the first barricade 505 of the frame 50 faces the air inlet 41 of the system 40, which prevents impurities, such as dust and liquid, from entering the centrifugal fan. The centrifugal fan is thus not damaged. Since the first barricade 505 is mainly to prevent the impurities from entering the centrifugal fan via the air inlet 41 of the system 40, the first barricade 505 can also be designed to have a straight and flat profile. Nevertheless, the profile and forming position of the first barricade 505 shown in FIG. 4A and FIG. 6A provide a better prevention of impurities entering the centrifugal fan and thus do not adversely affect flow of air. Alternatively, the air inlet 41 may be formed on different sides of the housing of the system 40. Similarly, the first barricade 505 may be formed in different positions on the centrifugal fan, as shown in FIG. 7A and FIG. 7B.

Figure 8:
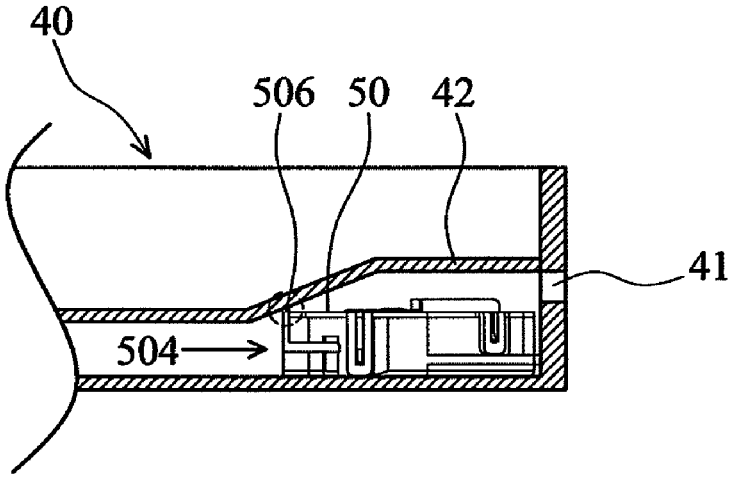
FIG. 8 is a schematic side view of a centrifugal fan of an embodiment of the invention applied in another system.
Figure 9A:
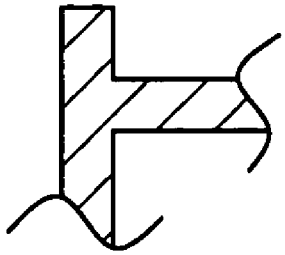
FIGS. 9A, 9B, 9C, and 9D are partial views of different top ends of the second barricades of the centrifugal fan of the invention.
Figure 9B:
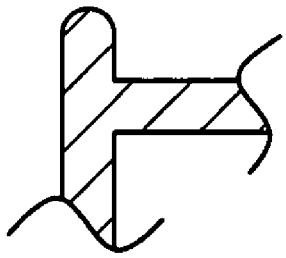
Figure 9C:
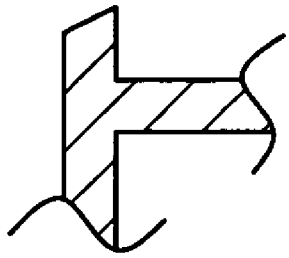
Figure 9D:
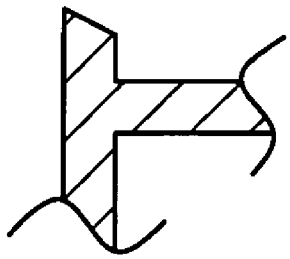

Referring to FIG. 8, the centrifugal fan can be applied in another system 40 with a housing and a guide plate 42. The guide plate 42 is disposed in the housing. When the centrifugal fan is disposed in the system 40, the second barricade 506 of the frame 50 tightly abuts the guide plate 42, such that reflow of air is reduced and heat dissipation of the system 40 is enhanced. Moreover, the second barricade 506 can be designed as required. For example, as shown in FIGS. 9A, 9B, 9C, and 9D, a top end (or an extending end) of the second barricade 506 can be formed with a planar, curved, or sloped surface. Thus, better abutment between the second barricade 506 and the guide plate 42 is achieved.

In conclusion, in the disclosed centrifugal fan, the first barricade prevents impurities from entering, and the second barricade tightly abuts the guide plate of the system. Thus, reflow of air is prevented and heat dissipation from the system is enhanced.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A centrifugal fan, comprising:

a frame comprising an air inlet and an air outlet, wherein a first barricade is partially formed on one side of the air inlet and extends outwardly for preventing impurities from entering the air inlet, and the first barricade has a curved-bar shape, wherein a second barricade is formed on a part of the periphery of the air outlet and extends outwardly, the first barricade being C-shaped with a notch, and the notch facing the second barricade;

an impeller disposed in the frame; and a motor disposed in the frame for driving the impeller.

2. The centrifugal fan as claimed in claim 1, wherein the frame comprises a top cover and a bottom cover, the top cover comprises a plurality of first engaging portions formed on the periphery thereof, and the bottom cover comprises a plurality of second engaging portions formed on the sidewall thereof and respectively engaging the first engaging portions.

3. The centrifugal fan as claimed in claim 2, wherein the first engaging portions comprise U-shaped retaining rings, and the second engaging portions comprise protrusions.

4. The centrifugal fan as claimed in claim 1, wherein part of the periphery of the air inlet near one side of the air outlet is straight.

5. The centrifugal fan as claimed in claim 1, wherein the air outlet outwardly expands from interior of the frame with respect to an opposite end thereof.

6. The centrifugal fan as claimed in claim 1, wherein the centrifugal fan is disposed in a system comprising a housing and a guide plate, and the guide plate is disposed in the housing and abuts the second barricade formed on part of the periphery of the air outlet of the centrifugal fan and extending outwardly.

7. A fan adapted to be disposed within a system with a housing, comprising:

a frame comprising an inlet and an air outlet, wherein a first barricade is partially on one side of the air inlet of the frame corresponding to an air inlet of the housing of the system for preventing impurities from entering the fan; and a second barricade is formed on a part of the periphery of the air outlet, wherein the first barricade is C-shaped with a notch, the notch facing the second barricade.

8. The fan as claimed in claim 7, wherein the frame comprises a top cover and a bottom cover, the top cover comprises a plurality of first engaging portions formed on the periphery thereof, and the bottom cover comprises a plurality of second engaging portions formed on the sidewall thereof and respectively engaging the first engaging portions.

9. The fan as claimed in claim 8, wherein the first engaging portions comprise U-shaped retaining rings, and the second engaging portions comprise protrusions.

10. The fan as claimed in claim 7, wherein part of the periphery of the air inlet near one side of the air outlet is straight.

11. The fan as claimed in claim 7, wherein the air outlet outwardly expands from interior of the frame with respect to an opposite end thereof.

12. The fan as claimed in claim 7, wherein the first barricade faces the air inlet of the system.

13. The fan as claimed in claim 7, further comprising a guide plate disposed in the housing and abutted the second barricade formed on part of the periphery of the air outlet of the fan and extending outwardly.

14. The fan as claimed in claim 7, wherein the second barricade has a curved or sloped surface.

* * * * *